US008766543B1

(12) United States Patent
Janning

(10) Patent No.: US 8,766,543 B1
(45) **Date of Patent: *Jul. 1, 2014**

(54) LED WITH INTERNAL BYPASS TRANSISTOR

(71) Applicant: JLJ, Inc., Bellbrook, OH (US)

(72) Inventor: John L. Janning, Bellbrook, OH (US)

(73) Assignee: JLJ, Inc., Bellbrook, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/080,325

(22) Filed: Nov. 14, 2013

Related U.S. Application Data

(60) Provisional application No. 61/901,411, filed on Nov. 7, 2013.

(30) Foreign Application Priority Data

Apr. 2, 2013 (CA) ..... 2811832

(51) Int. Cl.
*H05B 37/00* (2006.01)

(52) U.S. Cl.
USPC ..... 315/122; 315/123; 315/185 R; 315/185 S

(58) Field of Classification Search
USPC ..... 315/119, 121–123, 185 R, 185 S
See application file for complete search history.

(56) References Cited

U.S. PATENT DOCUMENTS

| | | | | |
|---|---|---|---|---|
| 4,017,847 | A * | 4/1977 | Burford et al. | 345/46 |
| 6,084,357 | A * | 7/2000 | Janning | 315/122 |
| 6,344,716 | B1 * | 2/2002 | Gibboney, Jr. | 315/185 S |
| 6,580,182 | B2 | 6/2003 | Janning | |
| 6,765,313 | B2 | 7/2004 | Janning | |
| 7,688,002 | B2 * | 3/2010 | Ashdown et al. | 315/291 |
| 8,324,820 | B2 | 12/2012 | Janning | |
| 8,415,887 | B1 * | 4/2013 | Janning | 315/185 R |
| 2006/0103320 | A1 | 5/2006 | Janning | |
| 2006/0220585 | A1 * | 10/2006 | Negley et al. | 315/185 R |
| 2007/0273296 | A9 | 11/2007 | Janning | |
| 2008/0150440 | A1 | 6/2008 | Hsu | |
| 2008/0211415 | A1 * | 9/2008 | Altamura | 315/192 |
| 2008/0265981 | A1 * | 10/2008 | Niessen et al. | 327/436 |
| 2009/0129077 | A1 | 5/2009 | Janning | |
| 2011/0068701 | A1 * | 3/2011 | van De Ven et al. | 315/185 R |
| 2011/0199003 | A1 * | 8/2011 | Muguruma et al. | 315/122 |
| 2012/0139428 | A1 * | 6/2012 | Grebner et al. | 315/185 R |
| 2012/0229030 | A1 | 9/2012 | Moskowitz et al. | |
| 2013/0043791 | A1 * | 2/2013 | Stack et al. | 315/122 |
| 2014/0015428 | A1 * | 1/2014 | Tao et al. | 315/187 |

* cited by examiner

*Primary Examiner* — Jason M Crawford
(74) *Attorney, Agent, or Firm* — Dickstein Shapiro LLP

(57) ABSTRACT

An LED with an internal bypass transistor, particularly suited for use in a series wired LED string to keep the string lit in the event of a failure of an LED. In one embodiment, the collector and/or base of the bypass transistor is used as one terminal of the shunt and the emitter is used as the opposite terminal. The preferred embodiment is to use the collector and emitter terminals only with the base terminal open.

2 Claims, 7 Drawing Sheets

LED WITH INTERNAL BYPASS TRANSISTOR

This application relates to U.S. Pat. No. 8,415,887 and claims priority to U.S. Provisional Application No. 61/901,411, filed Nov. 7, 2013, the disclosures of which are herein incorporated by reference.

FIELD OF THE INVENTION

The present invention relates to an LED for use in a series connected light string and, more particularly to an LED with an internal bypass transistor to ensure illumination of the light string in the event an LED becomes inoperable or is missing.

BACKGROUND OF THE INVENTION

Light Emitting Diode (LED) light strings have become quite popular recently for holiday decorating. They are much more energy efficient than incandescent lighting that has been around for many years. Since both the LED and the more conventional incandescent mini-light operate at very low voltage—usually between 2.0 to 3.5 volts—they are wired in electrical series connection with approximately 35 to 50 lights in a light string. As with incandescent lighting, when an LED bulb burns out, is loose or missing from the socket, the entire series light string goes out. To prevent this, bypass shunts can be wired across each LED to continue current through the light string in the event of such a failure.

Various other attempts have heretofore been made to provide various types of shunts in parallel with each series light of a series wired light string, whereby the string will continue to be illuminated whenever a light has burned out, or otherwise provide for an open circuit condition. For example, in Applicant's U.S. Pat. No. 6,580,182, entitled SERIES CONNECTED LIGHT STRING WITH FILAMENT SHUNTING, the disclosure of which is incorporated by reference herein, there is disclosed and claimed therein various novel embodiments which very effectively solve the prior art failures in various new and improved ways. For example, there is disclosed therein a series string of lights powered AC voltage, each light having a silicon type voltage regulating shunting device connected thereacross which has a predetermined voltage regulating value which is greater than the voltage normally applied to said lights, and which said shunt becomes fully conductive only when the peak voltage applied thereacross exceeds its said predetermined voltage switching value, which occurs whenever a light in the string either becomes inoperable for any reason whatsoever, even by being removed or falling from its respective socket, and which circuit arrangement provides for the continued flow of rated current through all of the remaining lights in the string, together with substantially unchanged illumination in light output from any of those remaining operative in the string even though a substantial number of total lights in the string are simultaneously inoperative for any combinations of the various reasons heretofore stated. There is disclosed therein various type of shunting devices performing the above desired end result, including back-to-back Zener, or so-called "avalanche" diodes, non-avalanche bilateral silicon switches, and conventional Zener diodes, one-half of which are electrically connected in one current flow direction and the remaining one-half being electrically connected in the opposite current flow direction.

In U.S. Pat. No. 6,084,357, a series of rectifier diodes are connected in an array across light sockets to continue current flow in the event of a failure. This patent teaches the use of two arrays connected in parallel in opposite electrical directions to simulate counter-connected Zener diodes. U.S. Pat. No. 6,580,182 teaches the use of two counter-connected (back-to-back) Zener diodes across each lamp socket. Other patents teach the use of a single Zener diode as a shunt in an AC rectified DC circuit.

Applicant's U.S. Pat. Nos. 6,084,357; 6,580,182 & 6,765,313 are incorporated here in their entirety. The circuits disclosed and claimed in those patents offer a vastly superior series connected light string with shunting which avoids much of the disadvantages of the prior art circuits noted above. U.S. Pat. No. 8,415,887, by the present inventor and owned by the present assignee, provides such a circuit for an LED light string. It would be desirable to provide an LED with an internal bypass transistor for use in the circuit of U.S. Pat. No. 8,415,887, to simplify the circuit and minimize cost.

It is therefore a principal object of the present invention to provide a simple and inexpensive, and yet highly effective, internal silicon type shunt, or bypass, for each of a plurality of series connected LEDs in a light string.

SUMMARY OF THE INVENTION

The present invention provides a unique and novel LED with an internal bypass transistor not used or considered before for a series wired light string. In one such LED, the collector and/or base of the internal transistor bypass device is used as one terminal of the shunt device and the emitter is used as the opposite terminal. The preferred embodiment is to use the collector and emitter terminals only with the base terminal open.

Other advantages, variations and other features of the invention will become apparent from the drawings, the further description of examples and the claims to follow.

DETAILED DESCRIPTION OF THE PREFERRED EMBODIMENTS

Figure 1:
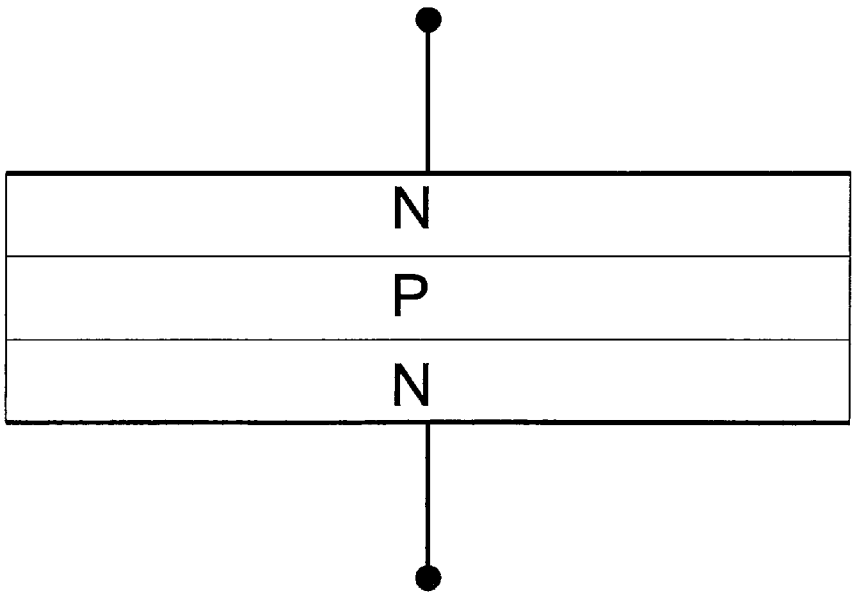
FIG. 1 and FIG. 1*a* show identical means of fabricating a high forward voltage drop bipolar junction diode or transistor bypass shunt device.
Figure 1A:
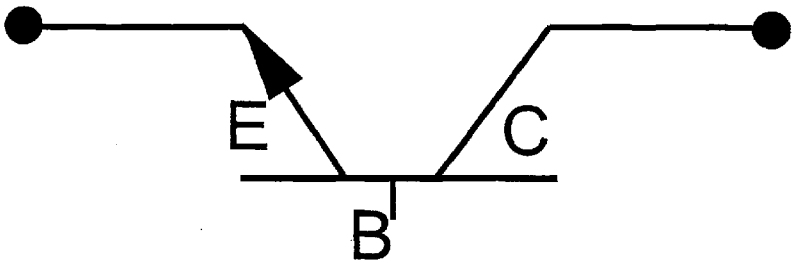

FIG. 1 and FIG. 1*a* show identical means of fabricating a high forward voltage drop bipolar junction diode or transistor bypass shunt device. While these drawings show NPN units, PNP units can also be fabricated as one skilled in the art knows. Diodes fabricated in this manner are unlike conventional diodes or Zener diodes as their IV curves are markedly different. Zener and conventional diodes have a positive slope to their IV curves. As current through these devices increase, so also does the voltage drop across the device increase. This is not true with the transistor bypass shunts described herein. The IV curve of this bi-directional junction diode type device described herein has an infinite to slightly less than infinite slope with increasing current.

Figure 4:
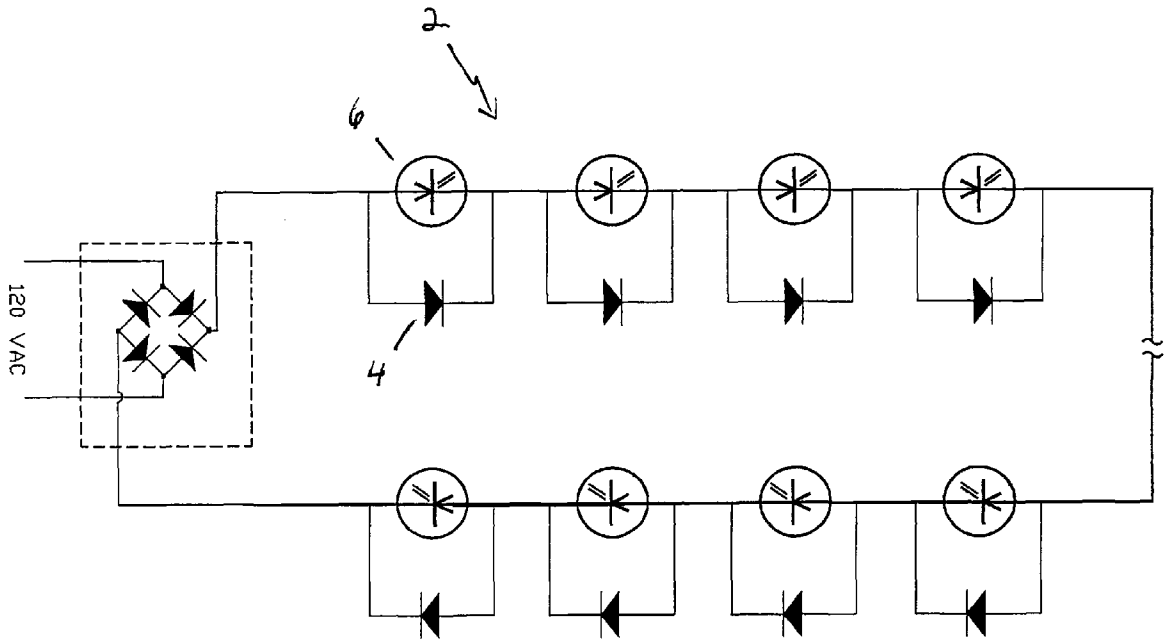
FIG. 4 shows a series wired LED string with high voltage forward diodes as bypass shunts across LEDs.

A rectifier diode with a forward voltage drop of between 3 to 10 volts, preferably about 4 volts, would be ideal as a bypass shunt in LED light strings. The reverse breakdown voltage should be at least 5 volts or more. FIG. 4 shows a series-wired LED light string 2 with high forward voltage diodes 4 as bypass shunts across LEDs 6, as described and claimed in U.S. Pat. No. 8,415,887. While these non-Zener devices are not voltage regulators, voltage regulation is not important in low current LED light strings.

Figure 2:
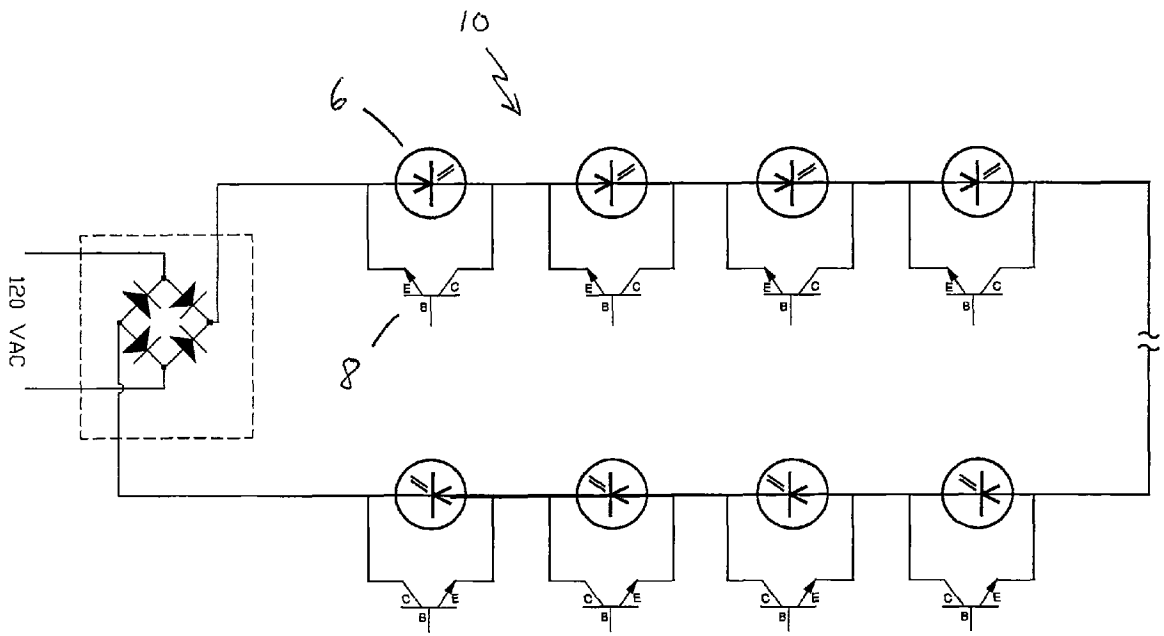
FIG. 2 shows a series wired LED string with NPN transistor shunts.

The desired operating shunt voltage would be approximately 4 volts at approximately 25 milliamperes, although devices with shunt voltages as high as 10 volts can be used as bypass shunts in LED light strings. Laboratory tests have shown the shunt voltage to be around six to eight volts for small signal transistors such as 2N2222; 2N3904 & 2N4401 devices on most all units tested. While these are NPN transistors, and the drawing of a series wired string 10 in FIG. 2 shows NPN units 8, PNP transistors work equally well in the present invention. This is well known to one skilled in the art.

Figure 3:
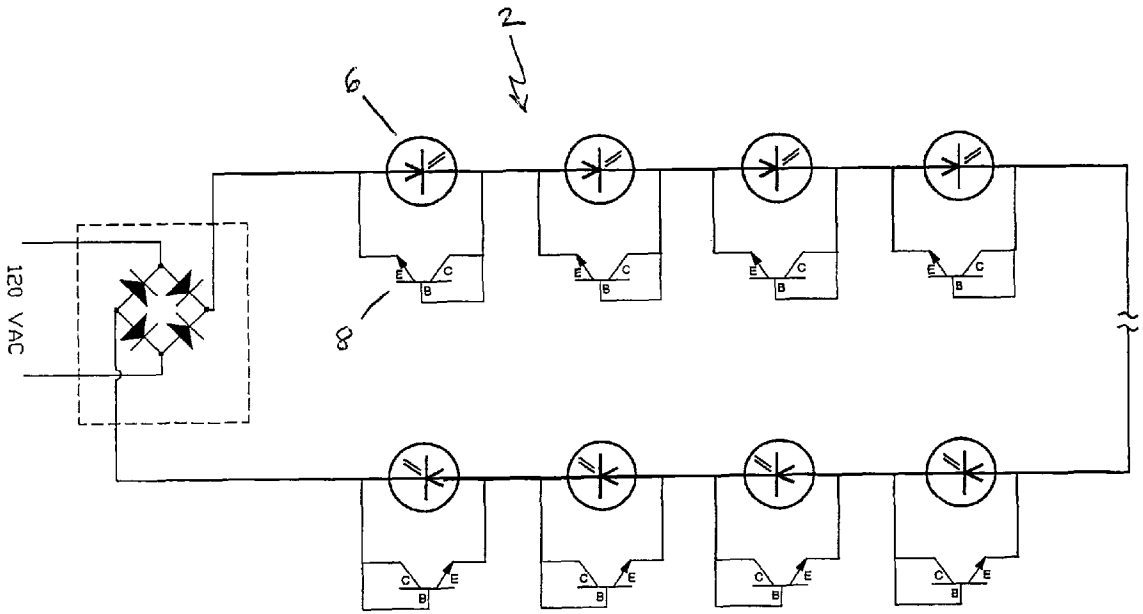
FIG. 3 shows a series wired LED string with NPN transistor shunts in which the base and collector of the transistor shunts are tied together.

Depending on the transistors and LEDs used, different transistor terminals might be desired as shunts. This could include base to emitter with collector open or the base and collector tied together versus the emitter as shown in FIG. 3. However, as stated earlier, the preferred embodiment is shown in FIG. 2, where the transistors collector and emitter terminals are used with the base open.

The preferred packaging for the bipolar junction diode bypass shunt is an axial package, such as the DO-35.

In accordance with the present invention, the LED and the transistor in the circuits of FIGS. 2 and 3 are preferably combined into one package, i.e., the bypass transistor is disposed with the LED housing.

Figure 5:
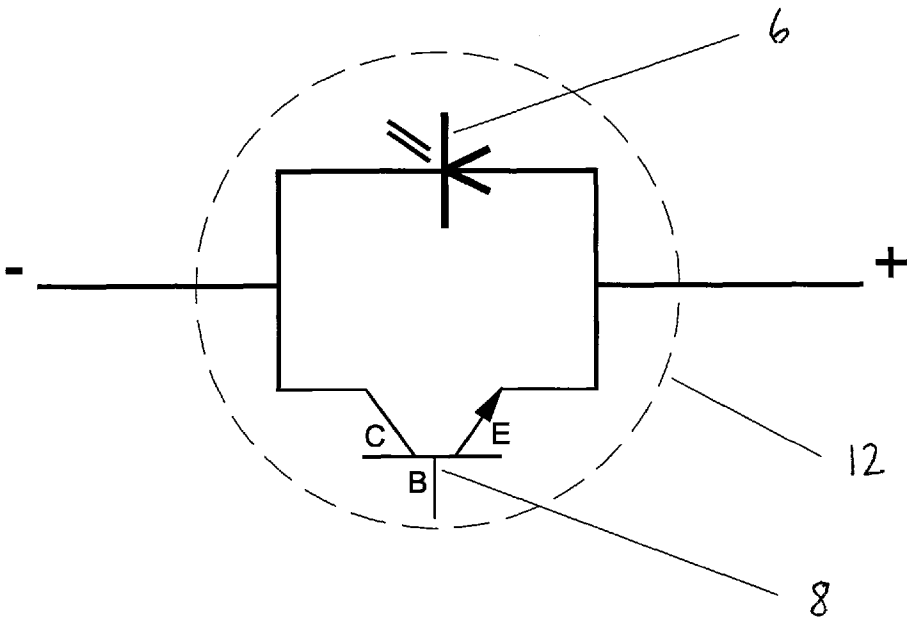
FIG. 5 shows an LED with an internal bypass transistor, with the emitter and collector terminals of the transistor connected across the LED, and with the base terminal of the transistor not connected.

FIG. 5 shows an LED with an internal bypass transistor 8 contained within housing 12, with the emitter and collector terminals of the transistor connected across the LED, and with the base terminal of the transistor not connected.

Figure 6:
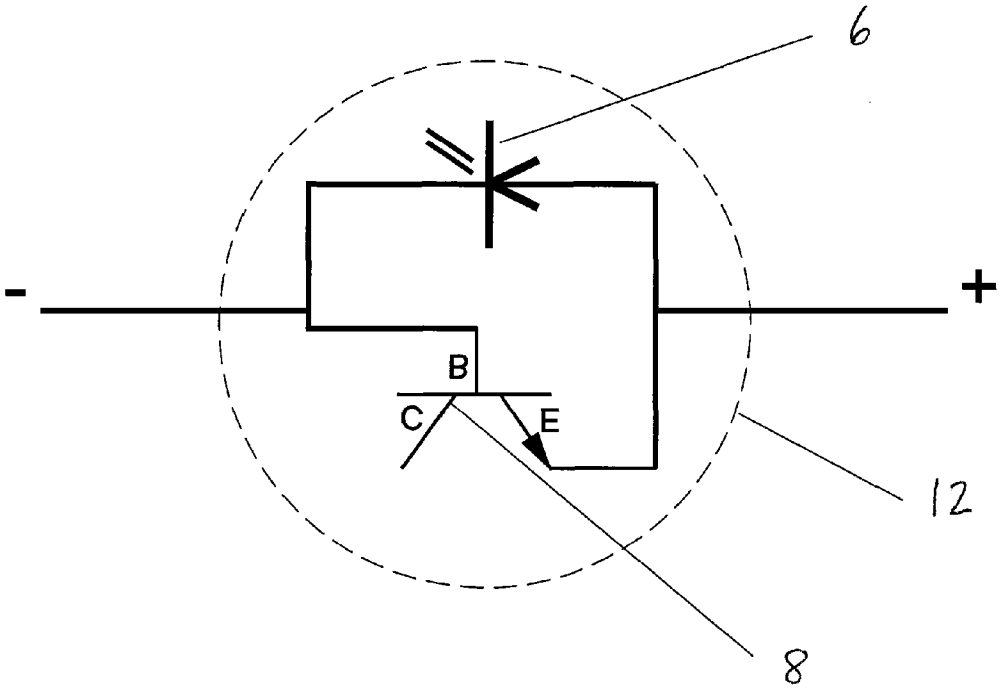
FIG. 6 shows an LED with an internal bypass transistor, with the base and emitter terminals of the transistor connected across the LED, with the collector terminal of the transistor not connected. If desired, the collector terminal can be connected to the base terminal.

FIG. 6 shows the base and emitter terminals of the internal bi-polar junction transistor 8 connected across LED 6, with the collector terminal of the transistor not connected. If desired, the collector terminal can be connected to the base terminal.

Although the invention has been described in detail in connection with the exemplary embodiments, it should be understood that the invention is not limited to the above disclosed embodiments. Rather, the invention can be modified to incorporate any number of variations, alternations, substitutions, or equivalent arrangements not heretofore described, but which are commensurate with the spirit and scope of the invention. Accordingly, the invention is not limited by the foregoing description or drawings, but is only limited by the scope of the appended claims.

What is claimed is:

1. An LED package comprising a housing, and an LED and a bypass transistor connected in parallel and disposed within the housing, the bypass transistor comprising a bipolar junction transistor with collector and emitter terminals connected to opposite sides of the LED, and with a base terminal not connected or connected to the collector terminal of the transistor, such that the transistor conducts no current when the LED is operating normally, and maintains current flowing through the LED package in the event that the LED is inoperative; wherein the bipolar junction transistor has a shunting voltage of more than three volts and less than ten volts.

2. A series-wired light emitting diode (LED) string that operates on DC voltage comprising a plurality of the LED packages as recited in claim 1 connected in electrical series.

* * * * *